US008381604B2

(12) United States Patent
Tandra et al.

(10) Patent No.: US 8,381,604 B2
(45) Date of Patent: Feb. 26, 2013

(54) INTELLIGENT SOOTBLOWER

(75) Inventors: Danny S. Tandra, Johns Creek, GA (US); Sandeep Shah, Suwanee, GA (US)

(73) Assignee: Clyde Beri Emann, Inc., Atlanta, GA (US)

( * ) Notice: Subject to any disclaimer, the term of this patent is extended or adjusted under 35 U.S.C. 154(b) by 136 days.

(21) Appl. No.: 13/152,357

(22) Filed: Jun. 3, 2011

(65) Prior Publication Data

US 2012/0305027 A1 Dec. 6, 2012

(51) Int. Cl.
*G01D 21/00* (2006.01)
*F28G 9/00* (2006.01)
*B08B 7/04* (2006.01)

(52) U.S. Cl. ..... 73/866.5; 122/390; 134/18

(58) Field of Classification Search ..... None
See application file for complete search history.

(56) References Cited

U.S. PATENT DOCUMENTS 5,416,946 A * 5/1995 Brown et al. ..... 15/318
5,615,953 A * 4/1997 Moskal ..... 374/7
2003/0047196 A1* 3/2003 Bartels et al. ..... 134/19
2006/0005786 A1* 1/2006 Habib et al. ..... 122/379
2011/0056313 A1* 3/2011 Dahlen et al. ..... 73/866.5

FOREIGN PATENT DOCUMENTS

EP 1939569 A1 * 7/2008
WO WO 2012099594 * 7/2012

* cited by examiner

*Primary Examiner* — Hezron E Williams
*Assistant Examiner* — Nathaniel Kolb
(74) *Attorney, Agent, or Firm* — Michael J. Mehrman; Mehrman Law Office, P.C.

(57) ABSTRACT

An intelligent sootblower that may be configured as a modification to an existing sootblower or a specially constructed sootblower that, in addition to its normal soot blowing functions, has the capability to measure the flue gas, lance tube, and/or cleaning fluid temperatures. One or more thermocouples or other temperature measuring devices are carried by the sootblower lance tube that is inserted into the boiler. This allows for the temperature of the flue gas, lance tube, and cleaning fluid to be measured as the sootblower lance tube is inserted into and retracted from the boiler. Multiple temperature measuring devices may be located on the sootblower lance to measure the temperature across heat transfer surfaces and at different locations along the lance tube. A data transfer device transmits the temperature measurements from the rotating thermocouple to a non-rotating data acquisition unit for use in boiler cleaning and other operations.

7 Claims, 17 Drawing Sheets

INTELLIGENT SOOTBLOWER

BACKGROUND

The entrainment of fly ash particles from the lower furnace of an industrial boiler to the convection sections of the boiler is an inevitable process. The accumulation of these particles in the fireside heat exchanger surfaces reduces the boiler thermal efficiency, creates a potentially corrosive environment at the boiler tube surfaces and, if the accumulation is not properly controlled, may also lead to costly unscheduled boiler shutdowns due to plugging of the gas passages.

Knowledge of the flue gas temperatures across the boiler heat transfer surfaces is therefore an important piece of information that can be used to evaluate fireside deposit characteristics, to improve boiler cleaning operation through intelligent deposit removal processes, and to optimize boiler operation and combustion processes. Conventional temperature sensors positioned in fixed locations on boiler walls or other internal boiler structures do not monitor flue gas temperatures across the boiler heat transfer surfaces. There is, therefore, a continuing need for effective ways of monitoring the internal temperature of flue gasses across heat transfer surfaces inside of industrial boilers.

Sootblowers are by far the most widely used equipment to remove the fireside deposit accumulations in industrial boilers, such as oil-fired, coal-fired, trash-fired, waste incinerator, as well as boilers used in paper manufacturing, oil refining, steel, and aluminum smelting and other industrial enterprises. A sootblower consists of a lance tube with one or more nozzles. During the deposit removal process, the sootblower lance rotates and extends through a small opening in the boiler wall, while blowing high pressure cleaning fluid (e.g., steam, air or water) directed into the tube banks. After the lance is fully extended, it rotates in the opposite direction as it retracts to its original inactive state.

The sootblower carriage consists of one or two electric motor(s), a gearbox and a packing housing. The electric motor is the main drive that moves the lance tube forward and backward during the cleaning cycle. The motor converts electrical energy into rotation motion, which is then used by the gearbox to rotate and move the lance tube along the gear rack. As the steam enters a sootblower, it is directed to four components in the following order: poppet valve, feed tube, lance tube, and nozzles. The lance tube is the main component that travels within the boiler while supplying the sootblower nozzles with high pressure steam directed by jets toward the boiler tubes. The lance travel includes insertion into and retraction from the boiler. During the cleaning process, the lance extends into the boiler and forms a structure similar to a cantilevered beam. Hence, the lance has to be designed to have sufficient strength to support its own weight in a high temperature environment.

To avoid overheating the lance tube during internal boiler operation, the blowing fluid, which also acts as a cooling medium, needs to be supplied continuously to the lance. The minimum amount of the cleaning media required to prevent the lance from overheating is known as the minimum cooling flow. The minimum cooling flow of a lance tube depends on the material, the length of the lance tube, the steam and flue gas temperatures. Knowledge of the lance tube temperatures as the lance is being exposed to hot flue gas inside the boiler is very important to prevent lance tube overheating and to devise emergency sootblower retraction control strategy. A continuing need therefore exists for effective ways for monitoring the temperature of the lance tube as the lance is exposed to hot flue gas inside the boiler.

SUMMARY OF THE INVENTION

The present invention meets the needs described above in an intelligent sootblower method and system for cleaning a heat transfer surface in a boiler. The intelligent sootblower includes an elongated lance tube configured to travel within the boiler while directing a cleaning fluid through one or more nozzles toward the heat transfer surface to remove fireside deposits from the heat transfer surface. A temperature sensor carried by the lance tube within the boiler obtains temperature measurements of flue gas within the boiler while the lance tube is located within the boiler. A boiler cleaning controller activates the sootblower to measure a temperature adjacent to the heat transfer surface, identifies a region of the heat transfer surface as a region that requires cleaning based at least in part on the measured temperature, and activated the sootblower to clean the region in response to the identification of the region that requires cleaning.

A data transfer device, such as a slip ring, may be used to transmit data from the temperature sensor to a non-rotating device. The non-rotating device may include the boiler cleaning controller or a data acquisition unit in communication with the boiler cleaning controller.

The boiler cleaning controller may activate the lance tube to travel adjacent to the heat transfer surface during a first pass to cause the temperature sensor to create a temperature profile for the heat transfer surface. It then activate the lance tube to travel adjacent to the heat transfer surface during a second pass to cause the sootblower to clean the region identified as requiring cleaning. The boiler cleaning controller typically causes the sootblower to emit a minimum cleaning flow sufficient to prevent the lance tube from overheating during the first pass. The system may also include a lance tube temperature sensor carried by the lance tube. In this case, then the boiler cleaning controller causes the sootblower to increment the minimum cleaning flow during the first pass in response to a temperature of the lance tube measured by the lance tube temperature sensor.

The boiler cleaning controller typically identifies the region requiring cleaning by comparing the temperature profile for the heat transfer surface to a clean surface threshold temperature based on a temperature profile for the heat transfer surface in a clean condition. The boiler cleaning controller may also identifies the region requiring cleaning by comparing the temperature profile for the heat transfer surface to a dirty surface threshold temperature based on a temperature profile for the heat transfer surface in a dirty condition.

In addition, the boiler cleaning controller may identify the region requiring cleaning by determining that the region is hotter than a clean surface threshold temperature based on a temperature profile for the heat transfer surface in a clean condition. If the temperature sensor is located downstream in a flue gas path from the heat transfer surface; the boiler cleaning controller may identify the region requiring cleaning by determining that the region is cooler than a clean surface threshold temperature based on a temperature profile for the heat transfer surface in a clean condition.

The sootblower may also be a first sootblower adjacent to a first side of the heat transfer surface and the system may include a second sootblower adjacent to a second side of the heat transfer surface. In this case, the boiler cleaning controller may identify the region requiring cleaning by determining a differential temperature between temperatures measured by the first and second sootblowers.

In view of the foregoing, it will be appreciated that the present invention avoids the drawbacks of prior boiler temperature measuring systems and provides an improved temperature sensing sootblower. The specific techniques and structures for creating the temperature sensing sootblowers, and thereby accomplishing the advantages described above, will become apparent from the following detailed description of the embodiments and the appended drawings and claims.

DETAILED DESCRIPTION OF THE PREFERRED EMBODIMENTS

This invention can be embodied in a temperature sensing sootblower that may be configured as a modification to an existing sootblower or a specially constructed sootblower that, in addition to its normal soot blowing functions, has the capability to measure the flue gas, lance tube, and/or cleaning fluid temperatures. One or more thermocouples or other temperature measuring devices are carried by the sootblower lance tube that travels within the boiler. This allows for the temperature of the flue gas, lance tube, and/or cleaning fluid to be measured as the sootblower lance tube is inserted into and retracted from the boiler. Multiple temperature measuring devices may be located on the sootblower lance to measure the temperature across heat transfer surfaces and at different locations along the lance tube. A data transfer device transmits the temperature measurements from the rotating thermocouple to a non-rotating data acquisition unit for use in boiler cleaning and other operations.

A data transfer device, such as a slip ring, is used to transfer the signal from the thermocouple to a data acquisition unit located on the non-rotating part of the sootblower. The invention may also be used in sootblowers that are partially inserted in the boiler (sometimes called half-track sootblowers). It may also be used in sootblowers that are continually inserted into the boiler gas path. The temperature sensor may be a thermocouple, a Resistance Temperature Detector (RTD), or other suitable type of sensing device that is attached to the lance tube of the sootblower.

Figure 1:
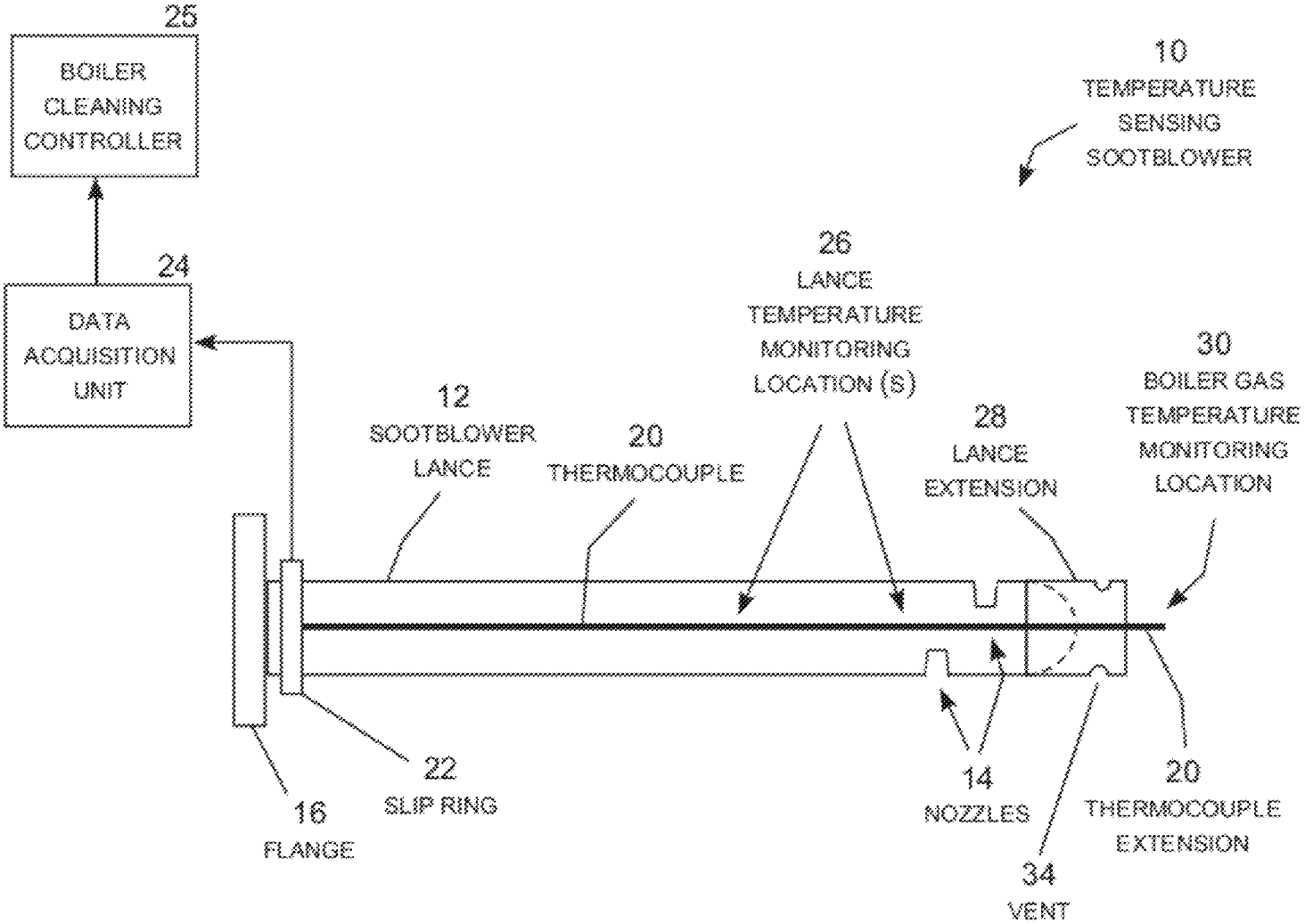
FIG. 1 is a schematic illustration of a temperature sensing sootblower.

FIG. 1 is a schematic illustration of the temperature sensing sootblower 10 including the lance tube 12 extending from a flange 16 that supports one end of the lance tube to the nozzles 14, which oppose each other to balance the force imposed on the lance by the fluid jets emitted from the nozzles. The lance tube is inserted through a hole in the boiler wall into interior of the boiler, where it is extended and retracted to clean heat transfer surfaces inside the boiler. The nozzles can be installed anywhere in the lance tube where one or more cleaning fluids, such as steam, air or water, are supplied to the nozzles to clean the fireside deposits from internal boiler heat transfer surfaces. The lance tube rotates as it travels in the insertion direction (from flange toward the tip of the lance), blowing a spiral of cleaning fluid as is travels across an adjacent heat transfer surface. The lance tube rotates in the opposite direction (from the tip of the lance toward flange) as it travels in the retraction direction.

To measure the temperature of the flue gas and the lance tube inside the boiler, the temperature sensing sootblower 10 carries temperature sensors, in this illustration a multi strand thermocouple 20 that extends longitudinally along the lance tube. The thermocouple is connected to a data transfer device, in this illustration a slip ring 22 that transfers the temperature measurements from the thermocouple to a data acquisition unit 24 while the thermocouple rotates with the lance tube. The data acquisition unit 24, in turn, transmits the temperature measurements to a boiler cleaning controller 25 or other processor that may use the measurements for a variety of purposes, such as displaying the temperature profile across heat transfer surfaces inside the boiler, activating sootblowers and other boiler cleaning equipment, adjusting boiler operation, retracting the lance tube to prevent overheating, and so forth. As the data acquisition unit 24 includes a processor, it may create temperature and perform some of these functions.

The thermocouple 20 is typically a stranded wire containing a number of two-wire thermocouples allowing for multiple temperature sensing locations 26 along the lance tube. For example, the thermocouple may include six wires providing three Type K thermocouples. This provides knowledge of the lance tube temperature so that the lance tube can be retracted to prevent overheating. The temperature along the lance tube may be monitored at multiple locations, as desired.

The thermocouple may also include a boiler gas monitoring location 30 positioned beyond the tip of the lance in the lance insertion direction. To obtain the temperature of the boiler flue gas rather than the lance tube, a lance tube extension 28 supports the thermocouple beyond the tip of the lance in the lance insertion direction. The thermocouple also extends a bit beyond the lance tube extension 28 so that the temperature monitoring location 30 is supported in the flue gas without physically touching the lance tube extension. For example, the lance tube extension 28 may extend four to six inches beyond the tip of the lance and the thermocouple 20 may extend another half inch to the boiler gas monitoring location 30. The lance tube extension 28 may also include one or more vents 34 to for cooling purposes. The lance tube extension is typically made from the same type of material as the lance tube and welded onto the tip of the lance.

Figure 2:
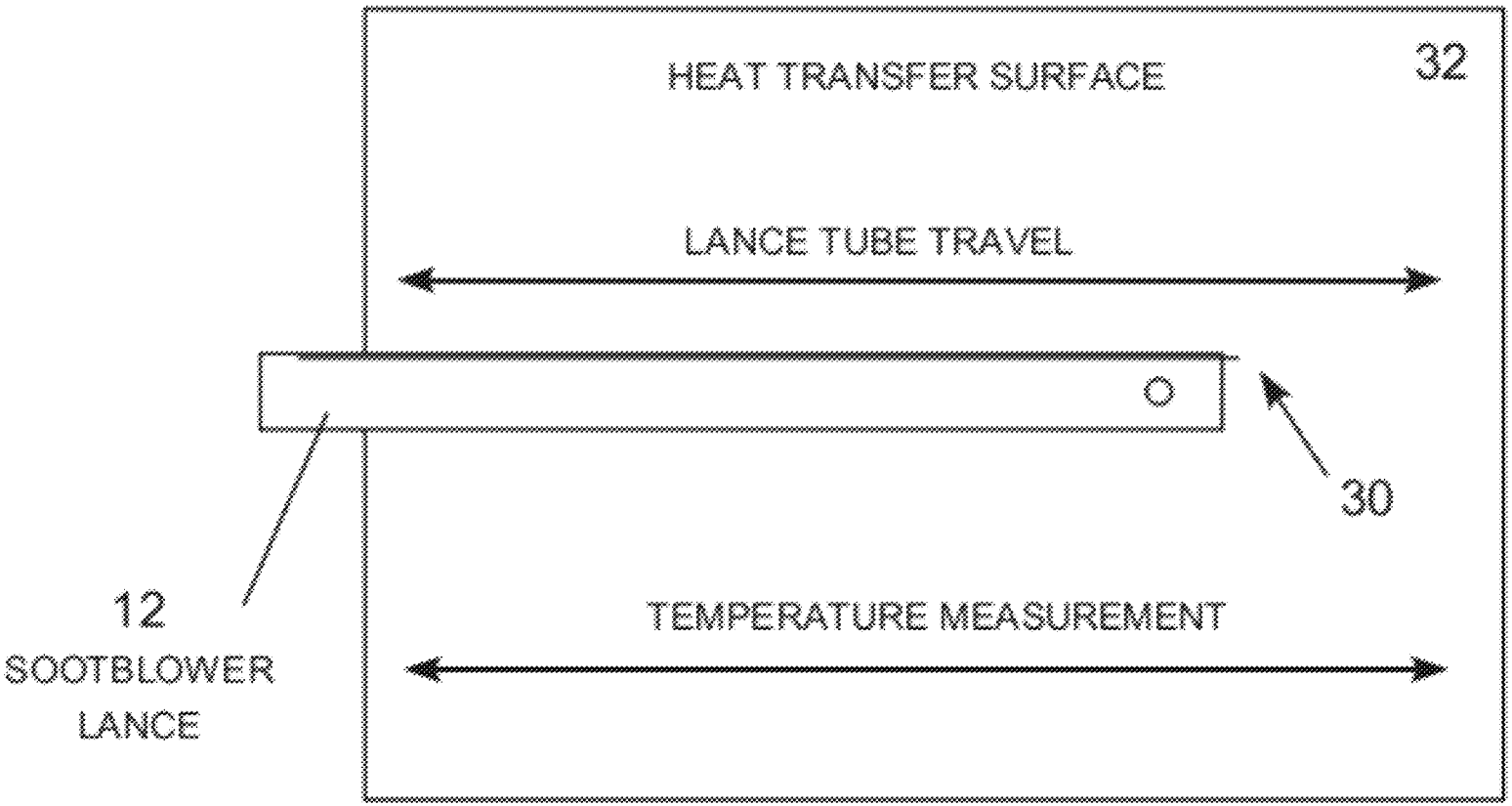
FIG. 2 is a conceptual illustration of the temperature sensing sootblower measuring the temperature of flue gas across a heat transfer surface in a boiler.

FIG. 2 is a conceptual illustration of the temperature sensing sootblower 10 measuring the temperature of flue gas across a heat transfer surface 32 in a boiler. The boiler gas temperature monitoring location 30 of the thermocouple 20 measures the temperature of the flue gas as the sootblower lance 12 travels adjacent to and across the heat transfer surface 32. The data acquisition unit 24 (FIG. 1) the boiler cleaning controller 25 (FIG. 1) or another processor creates a profile of the internal temperature of the boiler across the heat transfer surface. The temperature profile generally indicates whether the heat transfer surface is carrying fireside deposits reducing the heat transfer capability of the heat transfer surface, allowing for intelligent boiler operation including intelligent sootblower operation. The temperature monitoring location(s) 26 also measure the temperature of the lance tube allowing the lance tube to be retracted to prevent overheating.

In general, the measured temperature above the clean surface reference temperature (optimal) or below the clean surface reference temperature (optimal) may indicate a dirty area on the heat exchanger needing cleaning. In particular, a measured temperature above the clean surface reference temperature indicates a dirty area on the heat exchanger needing cleaning. On the other hand, a measured temperature below the clean surface reference temperature may indicate a clean heat exchanger surface when the lance is upstream from the heat exchanger surface, or it may indicate a dirty area on the heat exchanger needing cleaning when the lance is downstream from the heat exchanger surface. The boiler cleaning algorithm described with reference to FIGS. 16-20 implements boiler cleaning in view of this situation.

Figure 3:
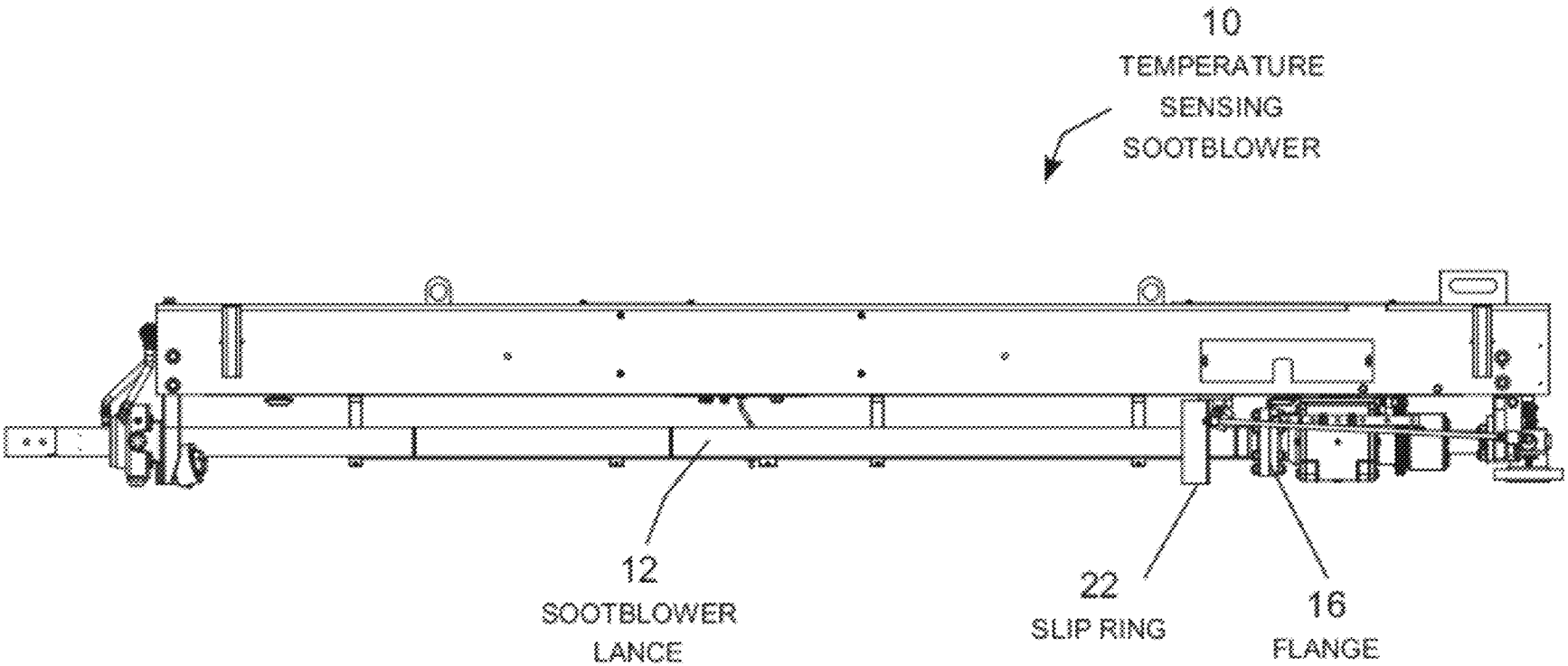
FIG. 3 is a side view of a temperature sensing sootblower showing the location of the slip ring data transfer device.

FIGS. 3-7 show an illustrative embodiment of the temperature sensing sootblower substantially to scale. FIG. 3 is a side view of the temperature sensing sootblower 10 indicating the location of the slip ring data transfer device 22 and the flange 16. The slip ring is typically mounted to a non-rotating plate positioned about six inches ahead of the flange 16 to prevent damage to the slip ring in the event of a steam leak from the flange. The slip ring includes a ball bearing or similar race with an inner sleeve that rotates with the lance tube and a non-rotating outer sleeve fixed to the plate wires connected to the inner sleeve are connected to the thermocouple while wires connected to the outer sleeve are connected to the data acquisition unit. This allows the slip ring to transmit the temperature measurements from the rotating thermocouple to the non-rotating data transfer unit. Another type of data transfer device may be used, however, such as a wireless data link between the thermocouple and the data acquisition unit or any other suitable type of data transfer device.

Figure 4:
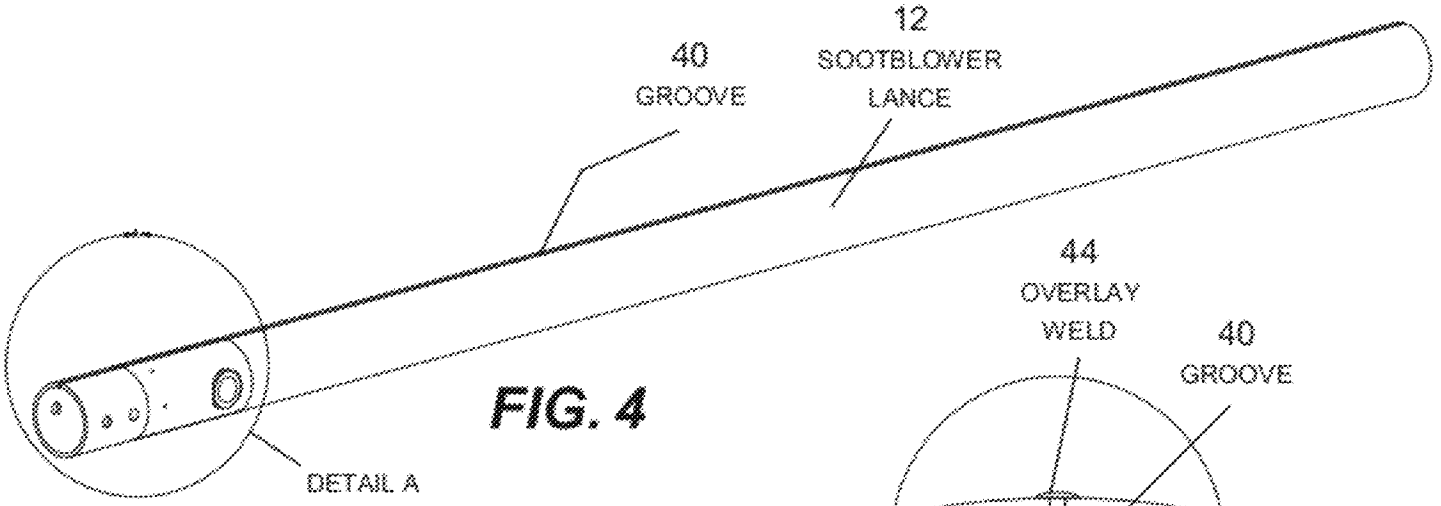
FIG. 4 is a perspective view of a temperature sensing sootblower lance.
Figure 5:
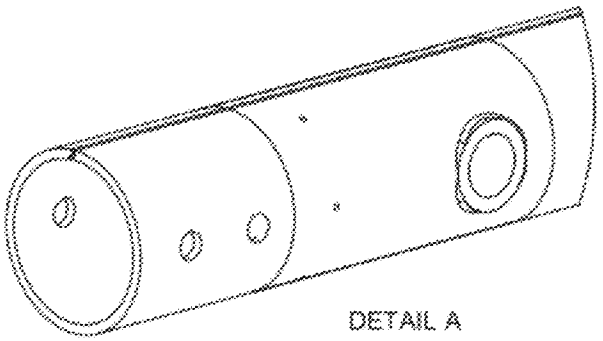
FIG. 5 is an enlarged view of Detail A of FIG. 7 showing the end of the temperature sensing sootblower lance.
Figure 6:
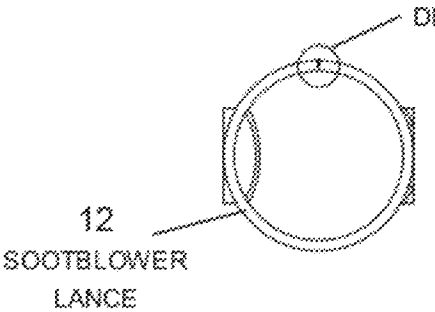
FIG. 6 is an end view of the temperature sensing sootblower lance.
Figure 7:
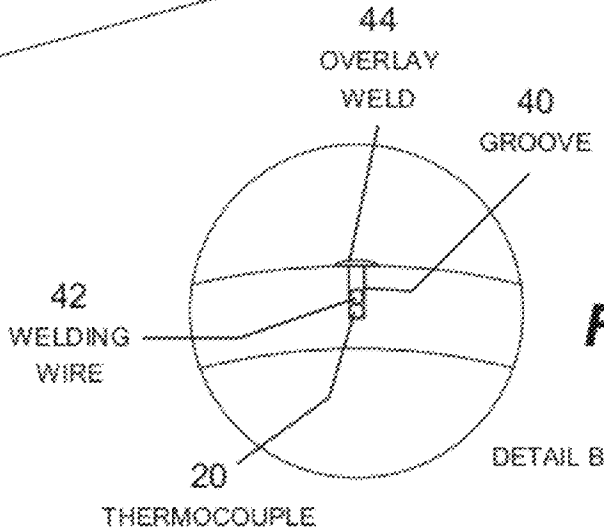
FIG. 7 is an enlarged view of Detail B of FIG. 6 showing the thermocouple temperature sensor, protective welding wire, and overlay weld.
Figure 8:
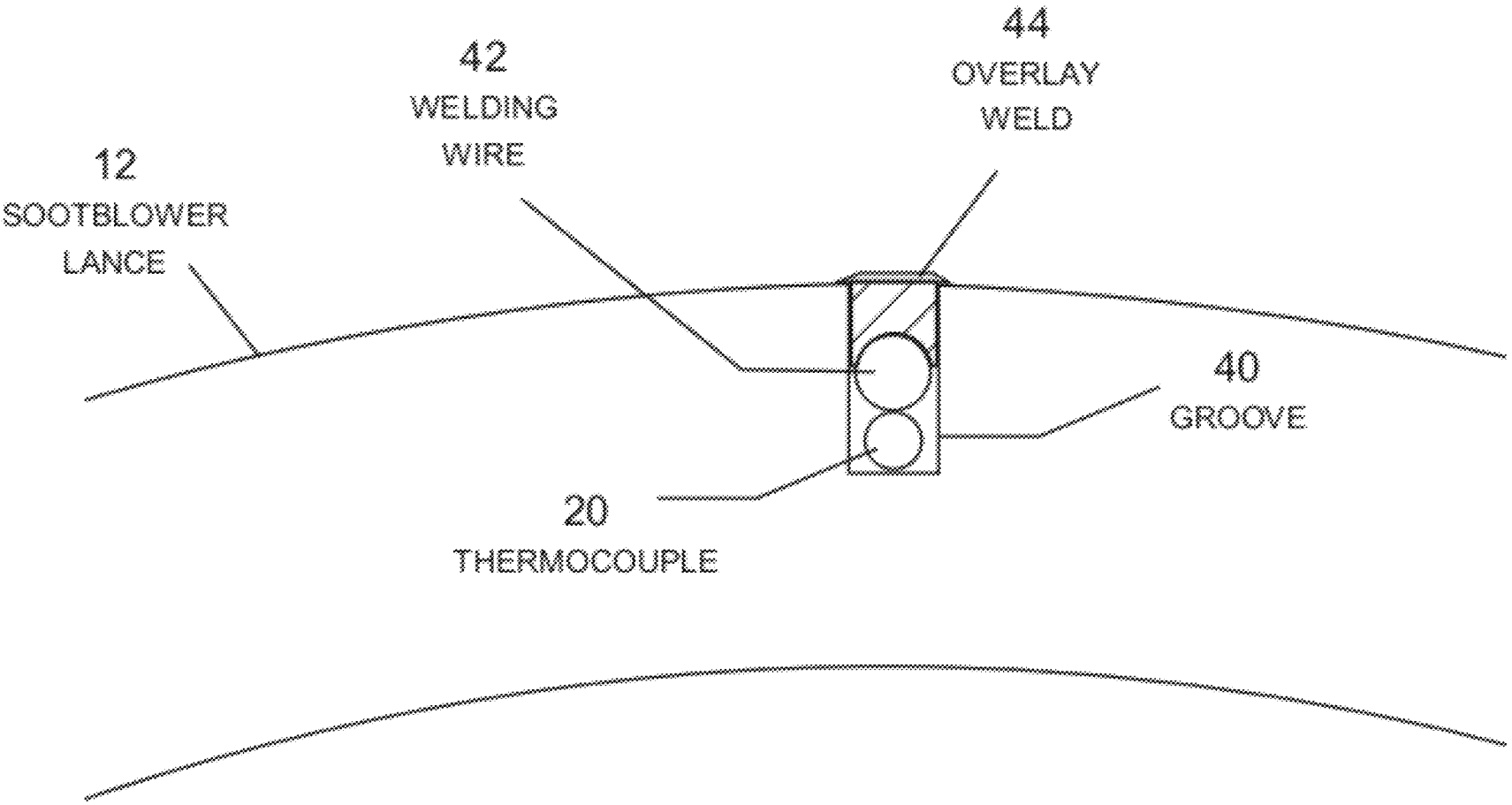
FIG. 8 is a further enlargement of the groove in the temperature sensing sootblower carrying the thermocouple temperature sensor, protective welding wire, and overlay weld.

FIG. 4 is a perspective view of the tip of the lance portion of the temperature sensing sootblower lance 12 with the groove 40. FIG. 5 is an enlarged view of Detail A of FIG. 4 showing the end of the temperature sensing sootblower lance including the lance tube extension 28. FIG. 6 is an end view of the temperature sensing sootblower lance 12 and FIG. 8 is an enlarged view of a Detail B of FIG. 7 showing the groove 40. FIG. 8 is a further enlargement of the groove 40 carrying the thermocouple 20, the protective welding wire 42, and the overlay weld 44. The groove, which extends from the slip ring to the end of the lance tube extension, may be machined or cut into the lance tube with saw. The thermocouple 20 is positioned at the bottom of the groove 40 with the protective welding wire 42 positioned above the thermocouple. An overlay weld 44 is welded over the grove to seal the thermocouple in the groove. The protective welding wire prevents the thermocouple from being damaged during the welding process. The groove 44 is cut approximately the same size as the protective welding wire to provide a snug interference fit between the groove and the welding wire. The thermocouple may be the same size or a smaller than the welding wire.

Figure 9:
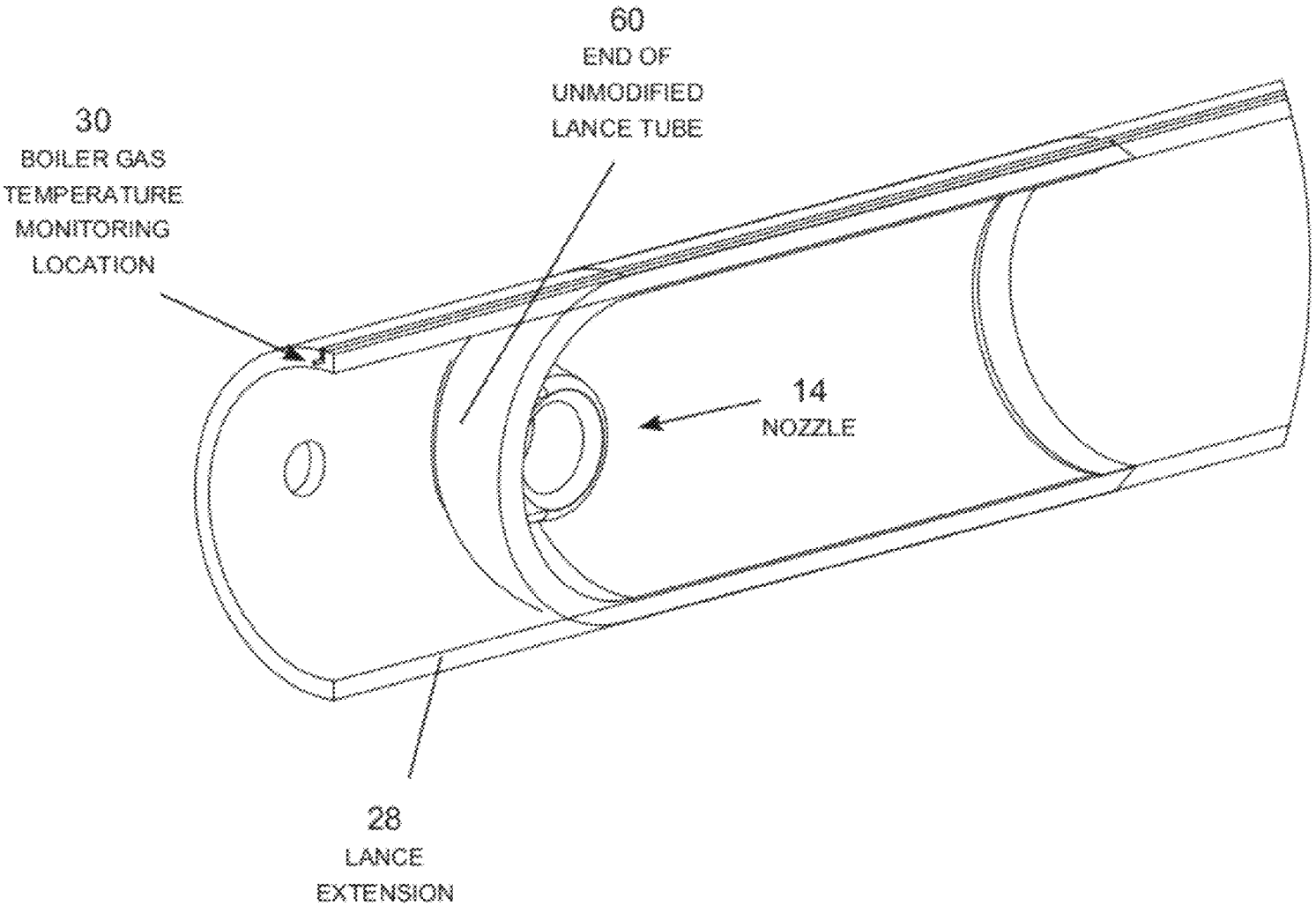
FIG. 9 is a cut away view of the end of the temperature sensing lance tube showing the boiler gas monitoring location and the end of the unmodified lance tube.

FIG. 9 is an enlarged cut-away view of the end of the temperature sensing sootblower lance tube 12 showing the boiler gas temperature monitoring location 30 at the end of the thermocouple extending beyond the end of the lance tube extension 28. FIG. 9 also shows the rounded end 60 of the unmodified lance tube.

Figure 10:
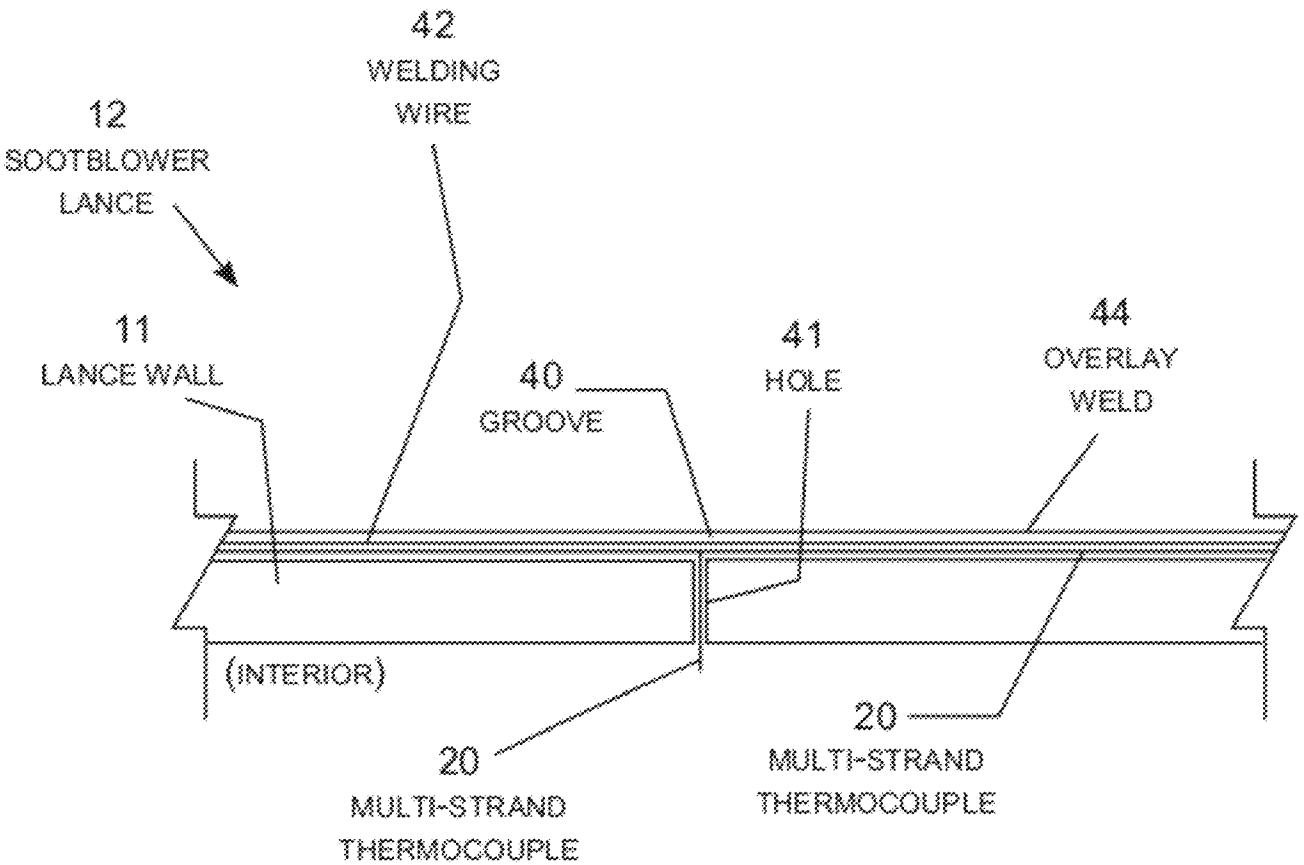
FIG. 10 is a conceptual cross sectional side view of a sootblower lance carrying a temperature sensor for measuring the temperature of the cleaning fluid inside the lance.

FIG. 10 is a conceptual cross sectional side view of a wall 11 of the sootblower lance 12 carrying a multi-strand thermocouple 20 within a grove 40, as described previously. In this example, the sootblower include a hole 41 extending from the grove through the wall 11. This allows a thermocouple to extend through the lance wall into the interior of the lance tube where it measures the temperature of the cleaning fluid inside the lance. It will be appreciated that any number of thermocouples can be deployed to measure the temperature of the lance tube, the gas outside the lance tube, and/or the cleaning fluid inside the lance tube at any desired locations along the lance tube. Thermocouples may also be used to measure the temperature of the lance tube on the inner surface, the outer surface, or at any desired depth within the lance tube wall.

Figure 11:
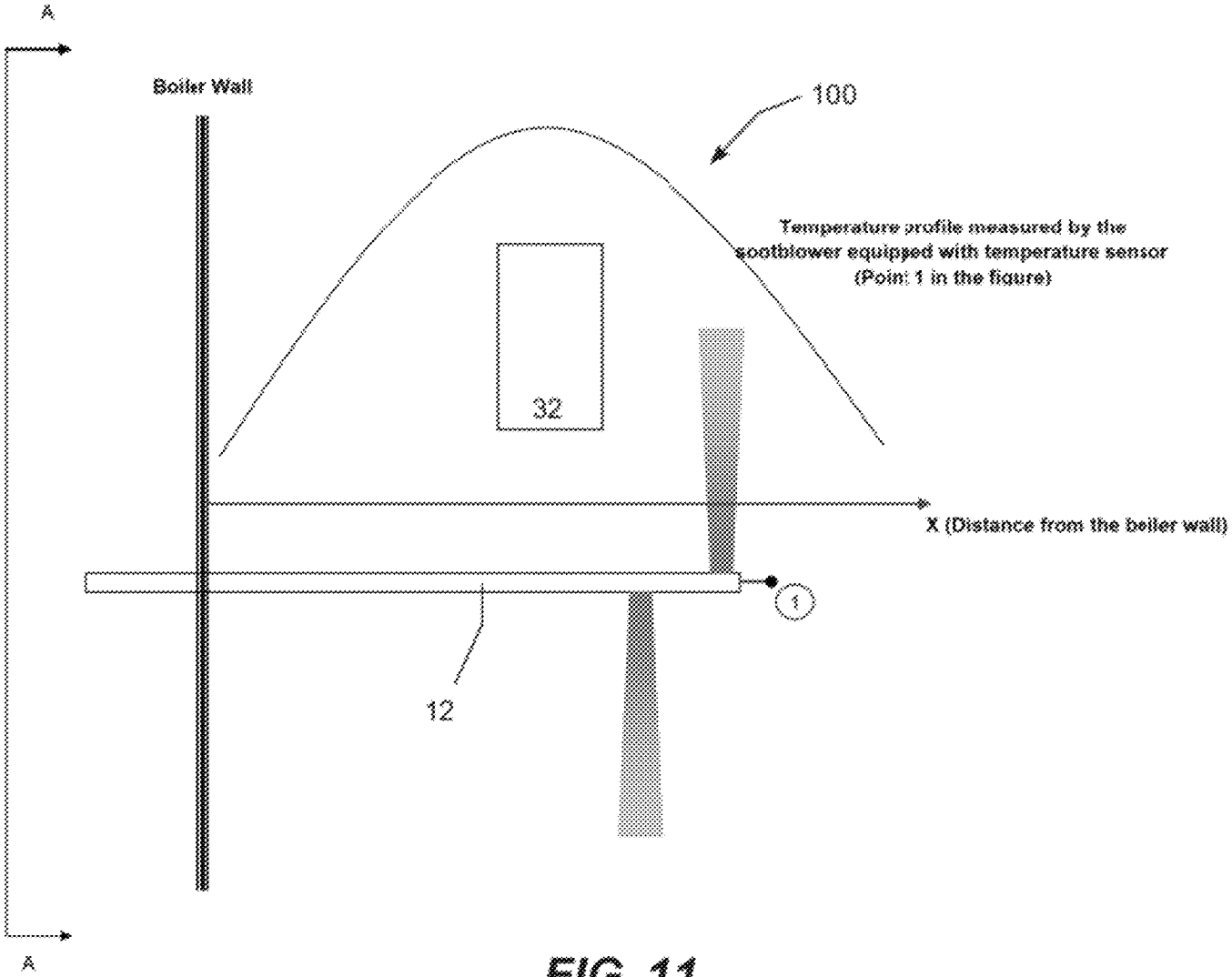
FIG. 11 is a conceptual illustration of a sootblower lance measuring a temperature profile inside a boiler.

FIG. 11 is a conceptual illustration of a temperature sensing sootblower lance 12 measuring a temperature profile 100 as it moves across a heat exchanger surface 32. The sootblower lance 12 maintains a minimum cooling flow of fluid through the lance at it travels past the heat exchanger surface 32. The objective is to measure the temperature profile 100 for comparison to a clean surface reference profile (optimal) for the surface to identify dirty areas on the surface that need cleaning. The measured temperature profile 100 may also be compared to a reference profile for the heat exchanger surface in a typical dirty condition to further help identify dirty areas on the surface that need cleaning. The identified dirty areas are typically cleaned in a subsequent pass so that the emission of a high flow of cleaning fluid does not interfere with the temperature measurement.

Figure 12:
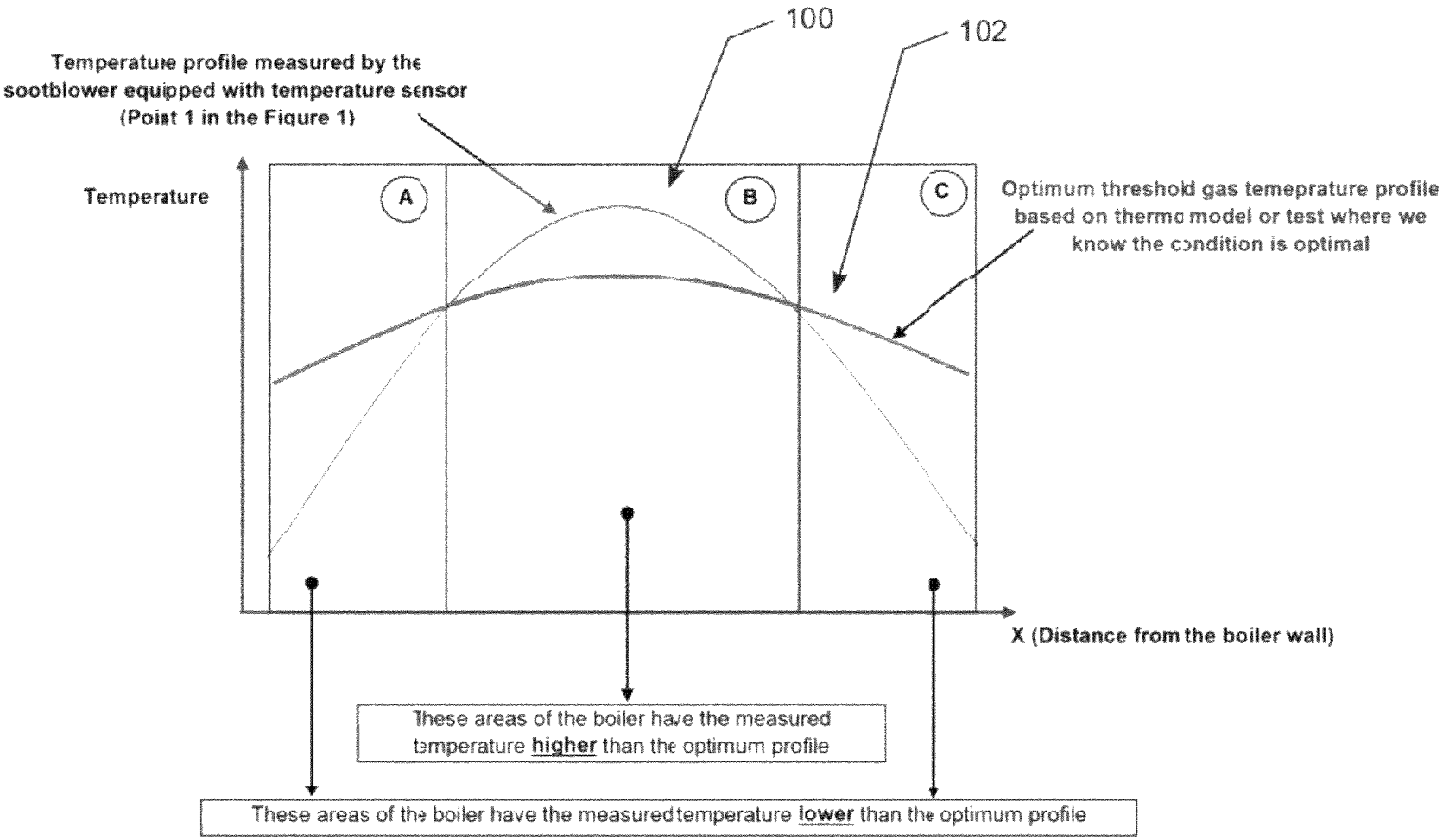
FIG. 12 is a graph illustrating a sootblower cleaning approach comparing a measured temperature profile to an optimal temperature threshold.

FIG. 12 is a graph illustrating a measured temperature profile 100 that is lower than the optimal temperature profile 102 in regions A and C and higher than the optimal temperature profile in region B. Dirty areas of the heat exchanger are identified by the comparison of the graph 100 and 102 taking into account whether the temperature measuring sootblower lance is upstream or downstream in the boiler gas path from the heat exchanger surface. A heat exchanger region with higher than optimal measured temperature, such as the region B in FIG. 12, is a fouled heat exchanger area that needs cleaning. In particular, if the lance is upstream from the heat exchanger surface, the fireside deposit 104 on the heat exchanger 32 blocks the flow of flue gas causing increased heating of the heating the lance upstream from the region of the deposit.

Figure 13:
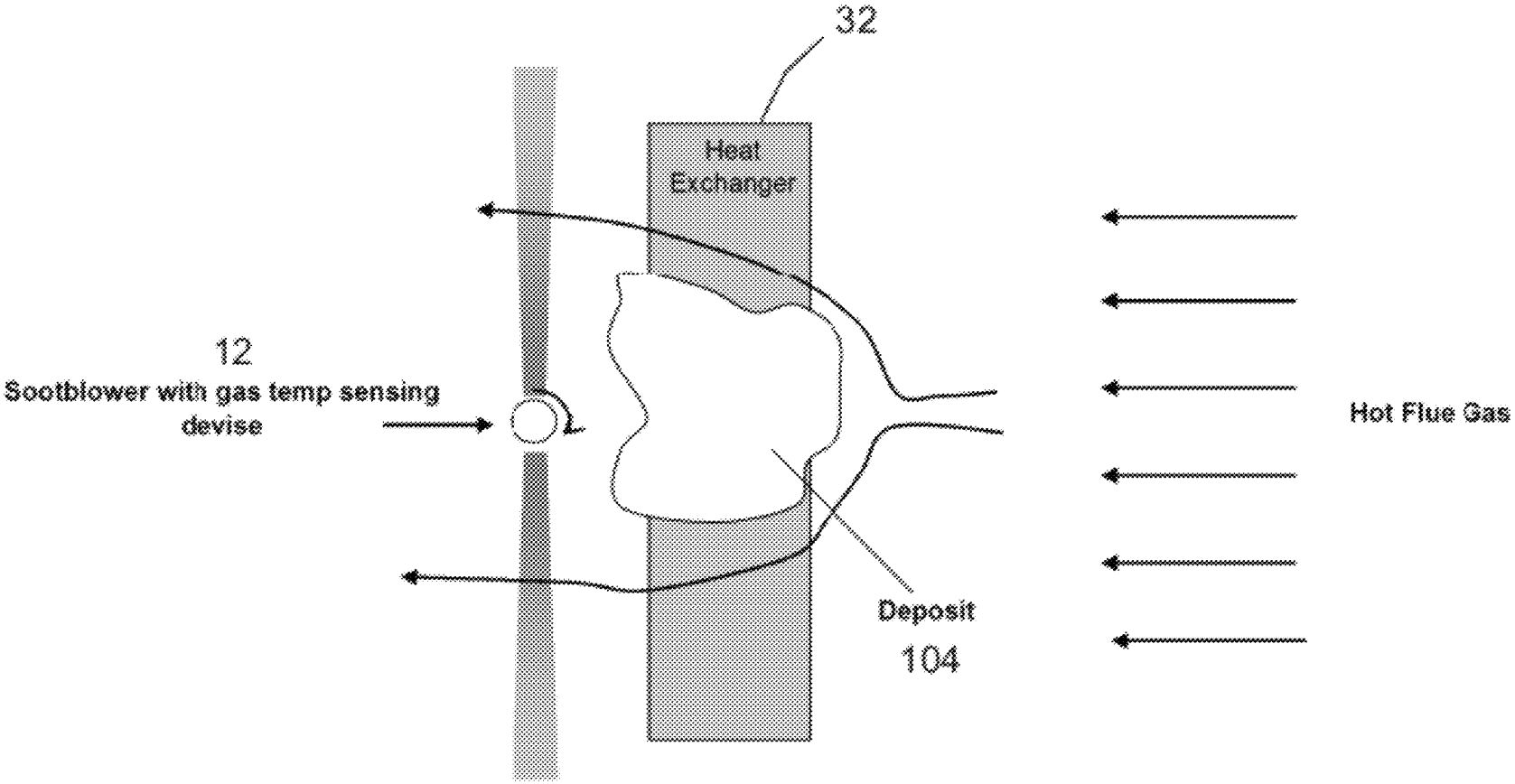
FIG. 13 is a conceptual illustration of a sootblower with a gas temperature sensor detecting an area of lower than optimal temperature indicating a dirty heat exchanger area that needs cleaning.

A heat exchanger region with a lower-than-optimal measured temperature represents an uncertain situation. If the lance is downstream from the heat exchanger surface, the regions A and C where the measured temperature profile 100 is below the optimal temperature profile 102 indicate the presence of a dirty heat exchanger surface. This situation is illustrated in FIG. 13, where the fireside deposit 104 on the heat exchanger 32 effectively blocks the flue gasses from heating the lance 12 in the region of the deposit. On the other hand, if the lance is upstream from the heat exchanger surface, the regions A and C where the measured temperature profile 100 is below the optimal temperature profile 102 indicate the presence of a clean heat exchanger surface.

Figure 14:
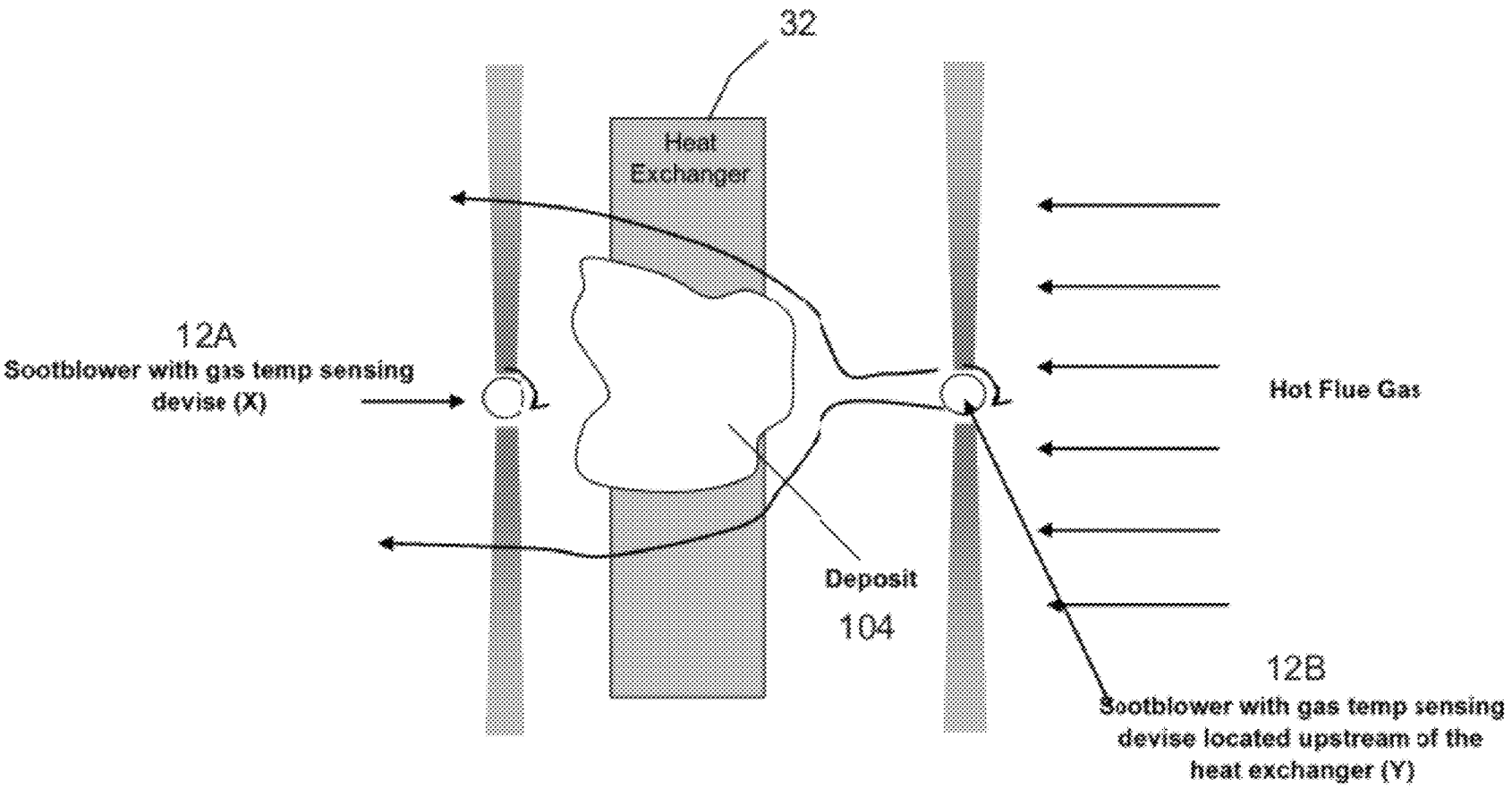
FIG. 14 is a conceptual illustration of a sootblower with a gas temperature sensor detecting an area of higher than optimal temperature indicating a dirty heat exchanger area that needs cleaning.
Figure 15:
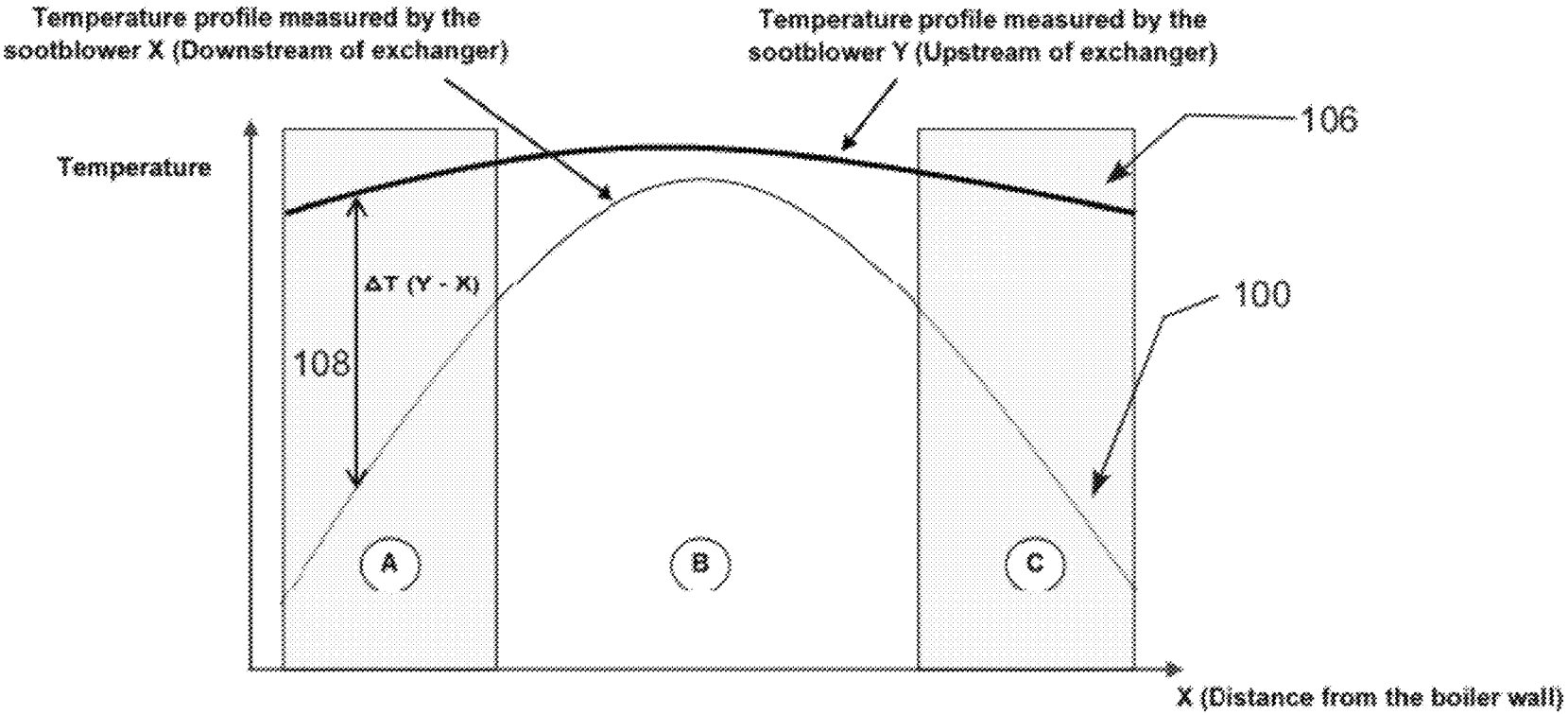
FIG. 15 is a graph illustrating a sootblower cleaning approach comparing a temperature profile measured upstream from a heat exchanger surface with a temperature profile measured downstream from a heat exchanger surface.

As a result, a measured temperature above the target temperature indicates a heat exchanger region that needs to be cleaned, whereas a measured temperature below the target temperature is ambiguous in that it may indicate a clean heat exchanger region if the lance is upstream from the heat exchanger surface or it may indicate a dirty heat exchanger surface if the lance is downstream from heat exchanger surface. To resolve any ambiguity, FIG. 14 illustrates the use of two temperature sensing sootblowers 12A and 12B, with sootblower 12A located downstream from the heat exchanger 32 and sootblower 12B located upstream from the heat exchanger. Fireside deposits can be accurately located with a combination of sootblowers taking temperature profiles in this configuration, which also allows both sides of the heat exchanger surface to be cleaned. FIG. 15 is a graph illustrating a sootblower cleaning approach comparing a temperature profile 106 measured upstream from a heat exchanger surface with a temperature profile measured 100 downstream from a heat exchanger surface. The differential temperature 108 can then be compared to a differential temperature threshold to identify dirty heat exchanger areas requiring cleaning. A measured differential temperature more than a threshold amount above the expected differential temperature for the heat exchanger surface for the given heat input condition indicates a dirty heat exchanger surface that needs cleaning.

Figure 16:
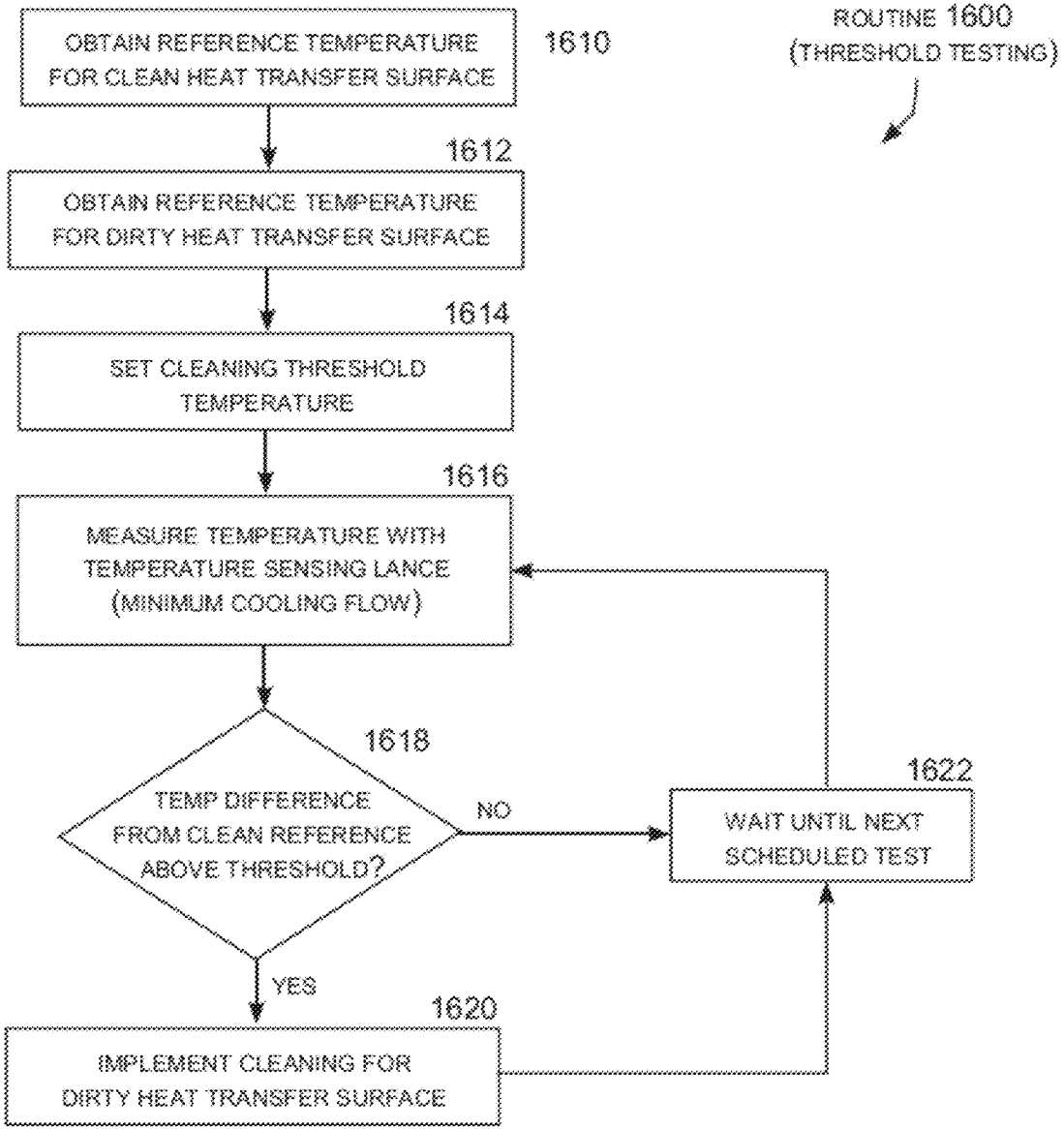
FIG. 16 is a logic flow diagram illustrating a routine for activating a boiler cleaning operation in response to flue gas temperatures measured with the temperature sensing sootblower.
Figure 17:
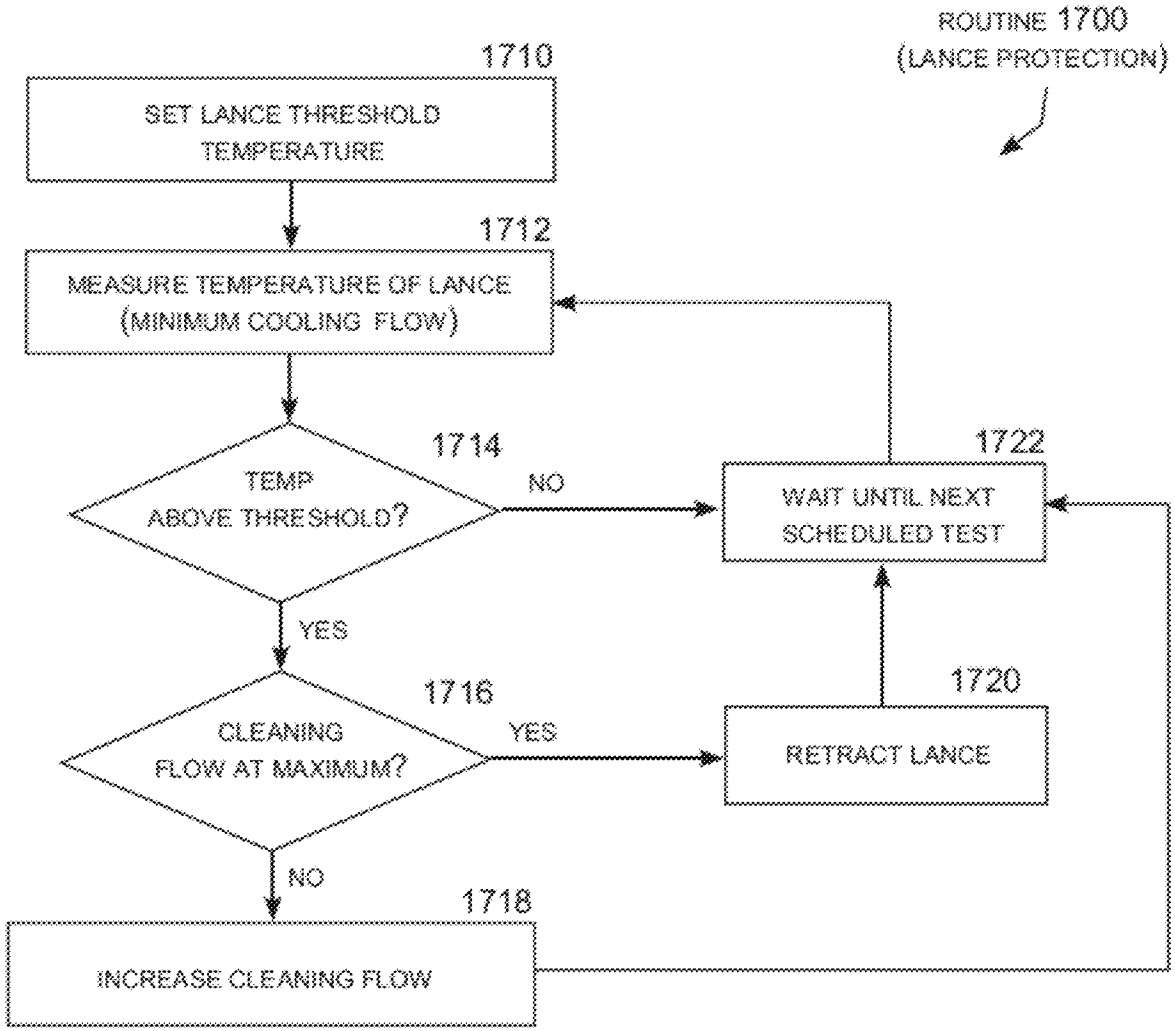
FIG. 17 is a logic flow diagram illustrating a routine for retracting the lance to protect the lance from overheating.

FIG. 16 is a logic flow diagram illustrating a routine 1600 for activating a boiler cleaning operation in response to flue gas temperatures measured with the temperature sensing sootblower. In step 1610, a reference temperature for a clean heat transfer surface is obtained, typically by measuring the temperature of the heat transfer surface when it is known to be in a clean state or through computer simulation. Step 1610 is followed by step 1612, in which a reference temperature for a heat transfer surface carrying accumulated slag (fireside deposit) is obtained, again by measuring the temperature of the heat transfer surface when it is known to be in an impacted state or through computer simulation. Step 1612 is followed by step 1614, in which the boiler cleaning controller is programmed with a cleaning threshold temperature based on the clean and dirty reference temperatures. For example, the cleaning threshold temperature may be set to be half way between the clean and impacted reference temperatures. Step 1614 is followed by step 1616, in which the boiler cleaning controller activates the temperature sensing sootblower to measure the boiler temperature while maintaining a minimum cleaning fluid flow necessary to avoid overheating of the lance. Routine 1700 shown in FIG. 17 is a methodology for controlling the minimum flow rate to prevent overheating of the lance while the temperature profile is measured. Step 1616 is followed by step 1618, in which the boiler cleaning controller determines whether the measured temperature is above the cleaning threshold temperature. If the measured temperature is above the cleaning threshold temperature, the "YES" branch is followed to step 1620, in which the sootblower is activated to clean the detected impacted surface. If the measured temperature is not above the cleaning threshold temperature, the "NO" branch is followed to step 1622, in which the sootblower cleaning controller waits for another scheduled test. Step 1620 is also followed by step 1622, which loops to step 1616, in which the boiler temperature is measured with the temperature sensing sootblower.

FIG. 17 is a logic flow diagram illustrating a routine 1700 for protecting the temperature sensing sootblower to avoid potential overheating, which may be applied while the lance is obtaining a temperature profile while emitting a minimum cooling flow (see FIG. 16, step 1616). In step 1710, the boiler cleaning controller is programmed with a threshold temperature for protecting the lance tube to avoid overheating of the lance tube, which is typically based on the material specifications for the lance tube and experience. For example, the threshold temperature may be set to 1,200° F. Step 1710 is followed by step 1712, in which temperature sensing sootblower is located within the boiler, typically for cleaning or temperature sensing operations while maintaining a minimum cleaning fluid flow necessary to avoid overheating of the lance. Step 1712 is followed by step 1714, in which the boiler cleaning controller determines whether the measured temperature of the lance tube is above the threshold temperature indicating potential overheating of the lance tube. If the measured temperature is above the threshold temperature, the "YES" branch is followed to step 1716, in which boiler cleaning controller determines whether the cleaning fluid flow through the sootblower is set to its maximum level. If the measured temperature is not set to its maximum level, the "NO" branch is followed to step 1718, in which the boiler cleaning controller increases the cleaning fluid flow through the sootblower by an incremental amount, such as 10% of the maximum cleaning fluid flow through the sootblower. If the measured temperature is set to its maximum level, the "YES" branch is followed to step 1720, in which the boiler cleaning controller retracts the sootblower lance to prevent overheating. Returning to step 1714, if the measured temperature is not above the threshold temperature, the "NO" branch is followed to step 1722, in which the boiler cleaning controller waits for the next scheduled test. Step 1718 is also followed by step 1720, which loops back to step 1712, in which the temperature of the lance is measured.

Figure 18:
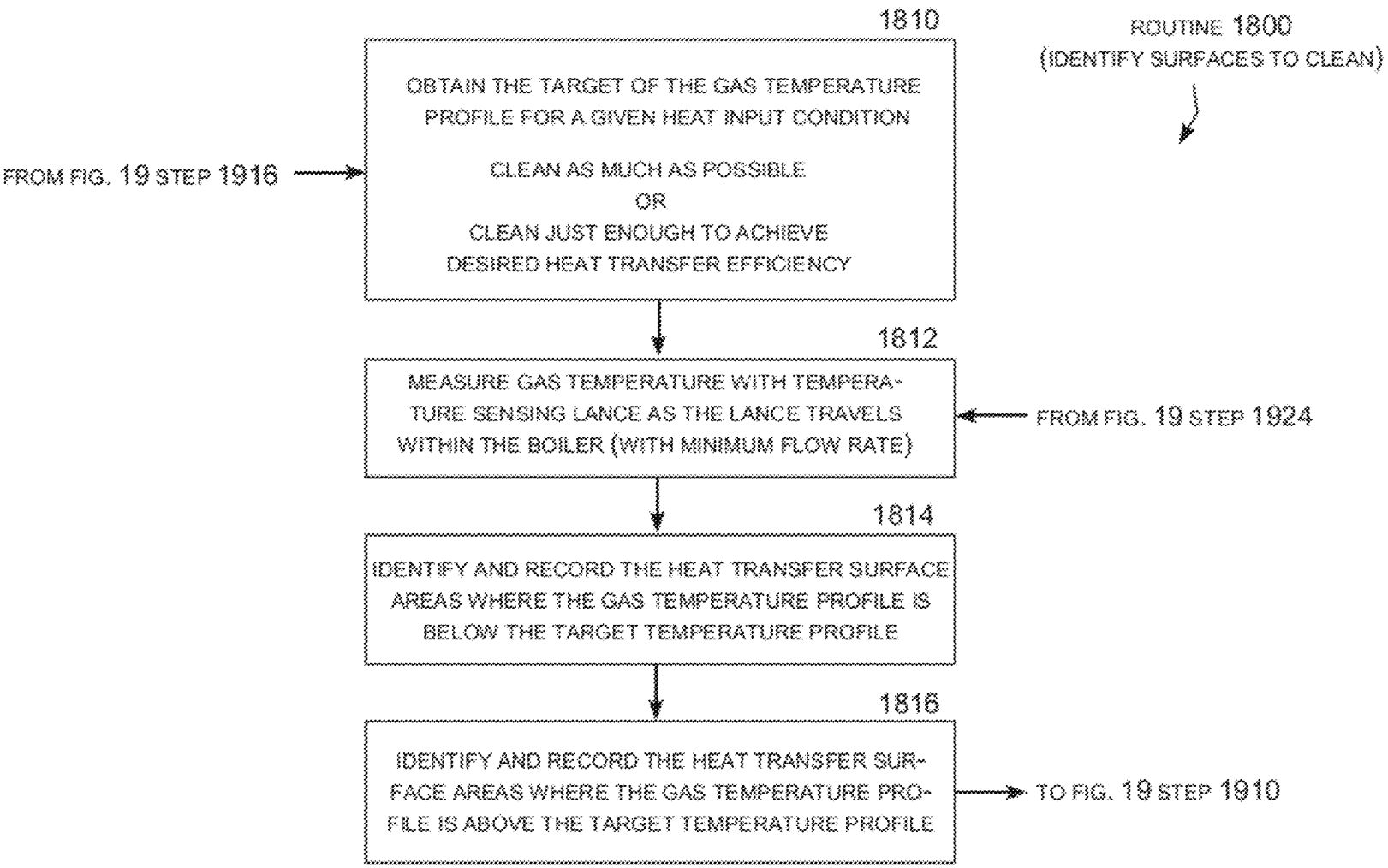
FIG. 18 is a logic flow diagram illustrating a routine for using a sootblower lance with a gas temperature sensor to identify heat exchange surfaces to clean.
Figure 19:
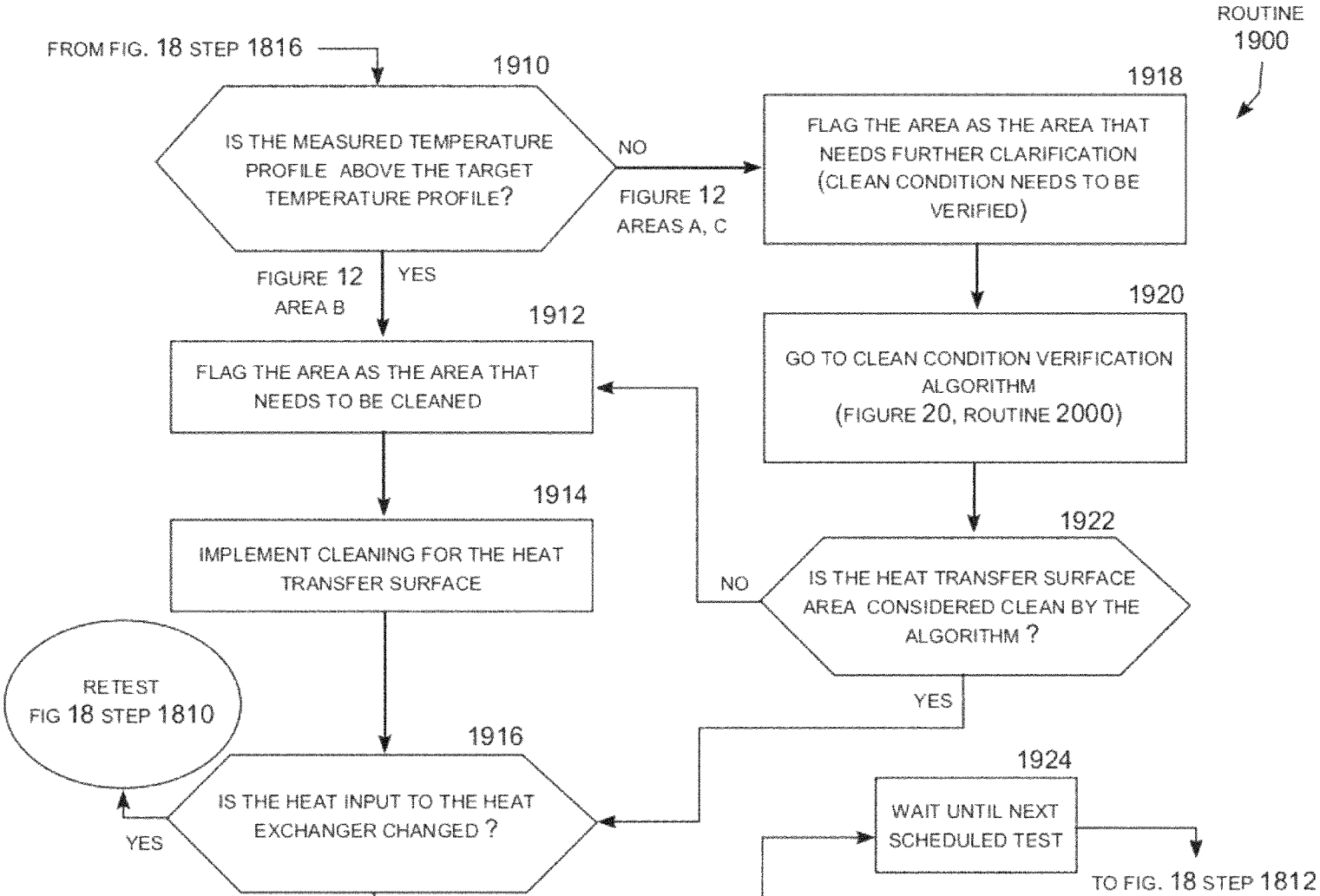
FIG. 19 is a logic flow diagram illustrating a routine for cleaning dirty heat exchanger surfaces.

FIG. 18 is a logic flow diagram illustrating a routine 1800 for using a sootblower lance with a gas temperature sensor to identify heat exchange surfaces to clean. In step 1810, the sootblower control system obtain the target of the gas temperature profile for a given heat input condition. This typically involves cleaning any dirty heat exchangers as much as possible or cleaning just enough to achieve desired heat transfer efficiency. This is because it may not be cost effective to always attempt to clean dirty heat exchangers as much as possible, but in some cases cleaning just enough to obtain desired heat transfer efficiency may be the most effective cleaning approach. It should be noted that the target gas temperature profile depends on the given heat input condition and must be carefully selected to be appropriate for the heat input condition existing in the boiler at the time of cleaning. That is, the desired target gas temperature profile will vary depending on the heat input condition existing at the time of cleaning. To accommodate different heat input conditions, the sootblower control system may store a number of target gas temperature profiles for a particular heat exchanger surface for different heat input conditions. The sootblower control system may also generate target gas temperature profiles on the fly by interpolating between stored profiles or by using boiler simulation software.

Step 1810 is followed by step 1812, in which the sootblower lance is inserted and retracted to obtain a temperature profile for the heat exchanger surface to be cleaned. The measuring step is implemented with a minimum flow rate through the lance to minimize the effect of the emitted fluid on the temperature measurement while still preventing the lance from overheating. Routine 1700 shown in FIG. 17 is a methodology for controlling the minimum flow rate to prevent overheating of the lance while the temperature profile is measured. Step 1812 is followed by step 1814, in which the sootblower control system identifies and records areas where the measured gas temperature profile is below the target temperature profile. These areas correspond to the regions A and C in FIG. 12. Step 1814 is followed by step 1816, in which the sootblower control system identifies and records areas where the measured gas temperature profile is above the target temperature profile. These areas correspond to the region B FIG. 12.

In general, the region B requires cleaning whereas the regions A and C require cleaning when the sootblower lance is downstream from the heat exchanger surface to be cleaned but not when the sootblower lance is upstream from the heat exchanger surface to be cleaned. This is explained in greater detail with reference to FIG. 19, which is a logic flow diagram illustrating a routine 1900 for cleaning dirty heat exchanger surfaces. Step 1816 from FIG. 18 is followed by step 1910, in which the sootblower control system determine whether the measured temperature profile at a particular location is above the target temperature profile. If the measured temperature profile at a particular location is above the target temperature profile, the "YES" branch is followed from step 1910 to step 1912, in which that area is flagged as an area that needs to be cleaned. Step 1912 is followed by step 1914, in which the sootblower control system implements cleaning for the flagged region of the heat exchanger surface. Step 1914 is followed by step 1916, in which the sootblower control system determines whether the heat input to the heat exchanger has changed. If the heat input to the heat exchanger has changed, the "YES" branch is followed from step 1916 to step 1810 on FIG. 18 to begin a retest for the new heat input level. If the heat input to the heat exchanger has not changed, the "NO" branch is followed from step 1916 to step 1924, in which the system waits for the next scheduled test and then returns to step 1812 on FIG. 18 to begin the next scheduled test.

Returning to step 1910, if the measured temperature profile at a particular location is below the target temperature profile, the "NO" branch is followed from step 1910 to step 1918, in which that area is flagged as an area that needs further clarification. Step 1918 is followed by step 1920, which is a clean condition routine 2000 shown on FIG. 20. Step 1920 is followed by step 1922, in which the sootblower control system determines whether the heat exchanger surface is considered clean by routine 2000. If the heat exchanger surface is considered clean, the "YES" branch is followed from step 1922 to step 1916, in which the sootblower control system determines whether the heat input has changed. If the heat exchanger surface is not considered clean, the "NO" branch is followed from step 1922 to step 1912, in which the heat exchanger surface is flagged for cleaning.

Figure 20:
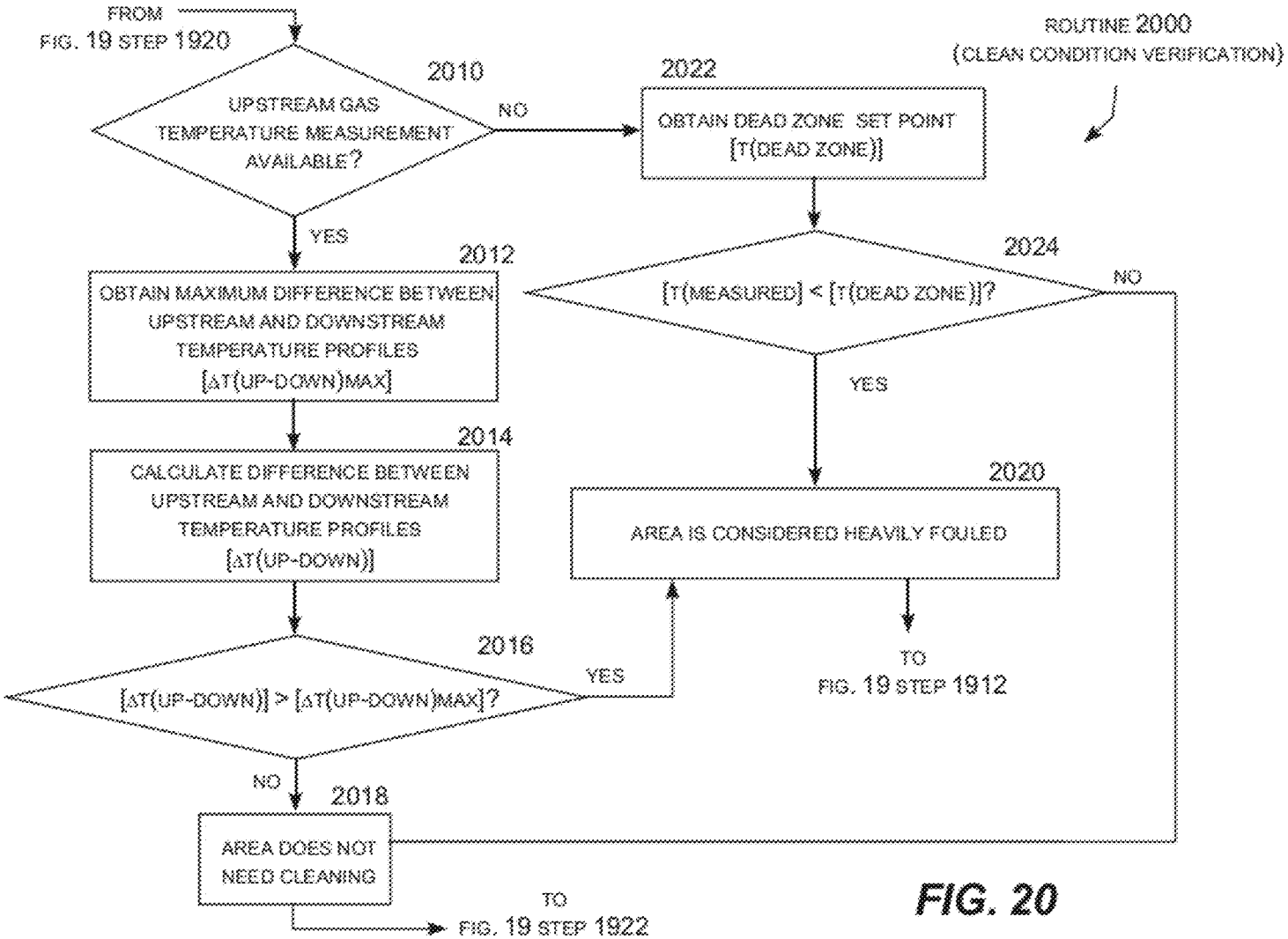
FIG. 20 is a logic flow diagram illustrating a routine for verifying whether a heat exchanger surfaces is clean.

FIG. 20 is a logic flow diagram illustrating routine 2000 for verifying whether a heat exchanger surface is clean. In step 2010, the sootblower control system determines whether an upstream temperature measurement is available. If an upstream temperature measurement is available, the "YES" branch is followed from step 2010 to step 2012, in which the sootblower control system obtains the maximum differential temperature (upstream temperature versus downstream temperature) for the heat exchanger surface in a clean condition (e.g., a threshold amount above the expected differential temperature for the heat exchanger surface in a clean condition, or a threshold amount above the expected differential temperature for a sufficiently clean the heat exchanger surface). Step 2012 is followed by step 2014, in which the sootblower control system calculates the measured differential temperature (upstream temperature versus downstream temperature) for the heat exchanger surface. Step 2014 is followed by step 2014, in which the sootblower control system determines the difference between the target and measured differential temperatures. If the measured differential temperature is below the target differential temperatures, the "NO" branch is followed from step 2016 to step 2018, in which the heat exchanger areas is flagged as clean. Step 2018 is followed by step 1922 on FIG. 19 with the heat exchanger region flagged as clean. If the measured differential temperature is above the target differential temperatures, the "YES" branch is followed from step 2016 to step 2020, in which the heat exchanger areas is flagged as heavily fouled and in need of cleaning. Step 2020 is followed by step 1912 on FIG. 19 with the heat exchanger region flagged as dirty.

Returning to step 2010, if an upstream temperature measurement is not available, the "NO" branch is followed from step 2010 to step 2022, in which the sootblower control system obtains a dead zone set point. Step 2022 is followed by step 2024, in which the sootblower control system determines whether the measured temperature is below the dead zone set point temperature. The dead zone set point represents a threshold level below the expected temperature downstream from the heat exchanger surface to be cleaned. A measured temperature below the dead zone set point indicated a fireside deposit on the heat exchanger surface upstream from the temperature sensor as shown in FIG. 13. If the measured temperature is below the dead zone set point temperature, the "YES" branch is followed form step 2024 to step 2020, in which the heat exchanger areas is flagged as heavily fouled and in need of cleaning. Step 2020 is followed by step 1912 on FIG. 19 with the heat exchanger region flagged as dirty. If the measured temperature is above the dead zone set point temperature, the "NO" branch is followed form step 2024 to step 2018, in which the heat exchanger areas is flagged as heavily fouled and in need of cleaning. Step 2018 is followed by step 1922 on FIG. 19 with the heat exchanger region flagged as clean.

In view of the foregoing, it will be appreciated that present invention provides significant improvements in sootblowers and boiler temperature monitoring systems and that numerous changes may be made therein without departing from the spirit and scope of the invention as defined by the following claims.

The invention claimed is:

1. A method for cleaning a heat transfer surface in a boiler, comprising the steps of:

providing a temperature sensing sootblower comprising an elongated lance tube configured to travel within the boiler while directing a cleaning fluid through one or more nozzles toward the heat transfer surface to remove fireside deposits from the heat transfer surface;

providing a temperature sensor carried by the lance tube within the boiler configured to obtain temperature measurements of flue gas within the boiler while the lance tube is located within the boiler;

activating the sootblower to measure a temperature adjacent to the heat transfer surface during a first pass to cause the temperature sensor to create a temperature profile for the heat transfer surface;

activating the sootblower to emit a minimum cleaning flow sufficient to prevent the lance tube from overheating during the first pass;

incrementing the minimum cleaning flow during the first pass in response to a temperature of the lance tube measured by a lance tube temperature sensor carried by the lance tube;

identifying a region of the heat transfer surface as a region that requires cleaning based at least in part on the measured temperature; and activating the lance tube of the sootblower to clean the region adjacent to the heat transfer surface during a second pass in response to the identification of the region that requires cleaning.

2. The method of claim 1, wherein the boiler cleaning controller identifies the region requiring cleaning by comparing the temperature profile for the heat transfer surface to a clean surface threshold temperature based on a temperature profile for the heat transfer surface in a clean condition.

3. The method of claim 1, wherein the boiler cleaning controller identifies the region requiring cleaning by comparing the temperature profile for the heat transfer surface to a dirty surface threshold temperature based on a temperature profile for the heat transfer surface in a dirty condition.

4. The method of claim 1, wherein the boiler cleaning controller identifies the region requiring cleaning by comparing the temperature profile for the heat transfer surface to a clean surface threshold temperature based on a temperature profile for the heat transfer surface in a clean condition and a dirty surface threshold temperature based on a temperature profile for the heat transfer surface in a dirty condition.

5. The method of claim 1, wherein the boiler cleaning controller identifies the region requiring cleaning by determining that the region is hotter than a clean surface threshold temperature based on a temperature profile for the heat transfer surface in a clean condition.

6. The method of claim 1, wherein: the temperature sensor is located downstream in a flue gas path from the heat transfer surface; and the boiler cleaning controller identifies the region requiring cleaning by determining that the region is cooler than a clean surface threshold temperature based on a temperature profile for the heat transfer surface in a clean condition.

7. The method of claim 1, wherein the sootblower is a first sootblower adjacent to a first side of the heat transfer surface: further comprising the step of providing a second sootblower adjacent to a second side of the heat transfer surface; and wherein the boiler cleaning controller identifies the region requiring cleaning by determining a differential temperature between temperatures measured by the first and second sootblowers.

* * * * *